US012188312B2

(12) United States Patent
Munir

(10) Patent No.: US 12,188,312 B2
(45) Date of Patent: Jan. 7, 2025

(54) WHIPSTOCK SETTING ARRANGEMENT, METHOD, AND SYSTEM

(71) Applicant: Baker Hughes Oilfield Operations LLC, Houston, TX (US)

(72) Inventor: Waqas Munir, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/169,509

(22) Filed: Feb. 15, 2023

(65) Prior Publication Data

US 2024/0271496 A1 Aug. 15, 2024

(51) Int. Cl.

| | |
|---|---|
| ***E21B 23/01*** | (2006.01) |
| ***E21B 23/03*** | (2006.01) |
| ***E21B 23/04*** | (2006.01) |
| ***E21B 47/12*** | (2012.01) |

(52) U.S. Cl.
CPC ..... *E21B 23/01* (2013.01); *E21B 23/03* (2013.01); *E21B 47/12* (2013.01)

(58) Field of Classification Search
CPC ... E21B 23/01; E21B 23/0411; E21B 23/0416
USPC ..... 73/152.36
See application file for complete search history.

(56) References Cited

U.S. PATENT DOCUMENTS 1,816,856 A * 8/1931 Kinzbach ..... E21B 23/01 166/117.6
1,835,227 A * 12/1931 Lane ..... E21B 7/061 166/212
1,951,638 A * 3/1934 Walker ..... E21B 7/061 166/212
2,227,347 A * 12/1940 Johnson ..... E21B 23/0411 30/106
3,115,935 A * 12/1963 Hooton ..... E21B 23/0411 166/212
5,488,989 A * 2/1996 Leising ..... E21B 47/18 166/117.6
6,364,037 B1 * 4/2002 Brunnert ..... E21B 7/061 166/324
6,755,248 B2 * 6/2004 Toulouse ..... E21B 4/02 166/117.6
7,178,589 B2 * 2/2007 Campbell ..... E21B 23/01 175/81

(Continued)

OTHER PUBLICATIONS

Notification of Transmittal of the International Search Report and the Written Opinion of the International Searching Authority, or the Declaration; PCT/US2024/015097; Mail date: Jun. 12, 2024; 9 pages.

*Primary Examiner* — Kenneth L Thompson
(74) *Attorney, Agent, or Firm* — Baker Hughes Company

(57) ABSTRACT

A whipstock anchor system including a whipstock, an anchor attached to the whipstock, an actuator operably connected to the anchor, and a whipstock support connected by a signal capable line to the actuator, the support including a trigger responsive to a flow rate of fluid past the support. A method for setting a whipstock anchor including running the system to a target depth, flowing fluid to a threshold rate, closing the trigger to complete a circuit, sending a signal with the closed circuit to the actuator, and setting the anchor. A borehole system including a borehole in a subsurface formation, a string in the borehole, a whipstock anchor system disposed within or as a part of the string.

19 Claims, 3 Drawing Sheets

(56) References Cited

U.S. PATENT DOCUMENTS

| | | | | |
|---|---|---|---|---|
| 8,127,858 | B2 * | 3/2012 | Lynde | E21B 23/01 166/212 |
| 9,140,083 | B2 | 9/2015 | Delgado et al. | |
| 11,136,843 | B1 * | 10/2021 | Nguyen | E21B 29/06 |
| 11,162,314 | B2 * | 11/2021 | Nguyen | E21B 7/061 |
| 11,346,190 | B2 | 5/2022 | Rogers et al. | |
| 2014/0131036 | A1 | 5/2014 | Huval et al. | |
| 2019/0093436 | A1 | 3/2019 | Costa De Oliveira et al. | |
| 2019/0226327 | A1 | 7/2019 | Telfer et al. | |
| 2021/0301610 | A1 | 9/2021 | Nguyen et al. | |

* cited by examiner

WHIPSTOCK SETTING ARRANGEMENT, METHOD, AND SYSTEM

BACKGROUND

In the downhole industry whipstocks are often needed to divert strings for one reason or another. Setting whipstocks to maintain a set position can sometimes be an issue and hence the art continues to seek alternatives that improve performance and efficiency.

SUMMARY

An embodiment of a whipstock anchor system including a whipstock, an anchor attached to the whipstock, an actuator operably connected to the anchor, and a whipstock support connected by a signal capable line to the actuator, the support including a trigger responsive to a flow rate of fluid past the support.

An embodiment of a method for setting a whipstock anchor including running the system to a target depth, flowing fluid to a threshold rate, closing the trigger to complete a circuit, sending a signal with the closed circuit to the actuator, and setting the anchor.

An embodiment of a borehole system including a borehole in a subsurface formation, a string in the borehole, a whipstock anchor system disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
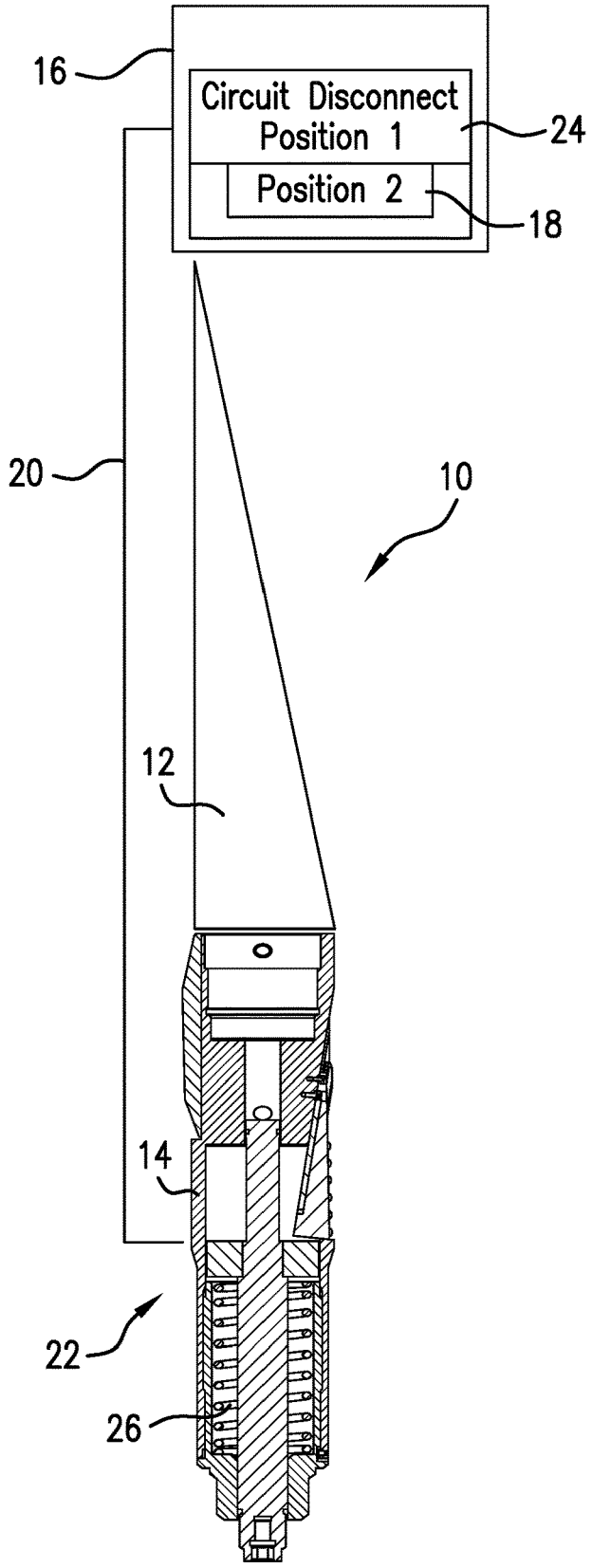
FIG. 1 is a schematic view of a whipstock anchor system as disclosed herein.

Referring to FIG. 1, a whipstock anchor system 10 is illustrated schematically. The system 10 includes a whipstock 12 having an anchor 14, that may be a slip or similar. The whipstock 12 is initially connected in a weight bearing manner to a whipstock support 16. The support 16 may in some embodiments be a mill but it is to be appreciated that in other embodiments, the support may have a support function alone and not be a mill. The support 16 includes a trigger 18 that is configured to respond to a preselected threshold fluid flow rate. In embodiments, the flow whose rate is the basis for meting the threshold may be within the support 16 or in some other embodiments, the trigger 18 may be configured to respond to fluid flow around the support 16. In either event, the trigger responds to the threshold fluid flow, for example a flow rate of 300-350 GPM, by closing a circuit. The circuit is closed to a battery or other power source that may be on the support 16 or may be a tether to remote location. In either event, the closure of the circuit sends a signal along a signal line 20 that extends between the support 16 and an actuator 22 on the whipstock 12. The signal may be electric, optic, hydraulic, etc. The circuit will include a generator for whatever type of signal is created. If the signal is electrical the battery itself will generate the signal but if it is optical, an optical signal generator will need to be in the circuit and if hydraulic, a pump or other source of hydraulic signal will need to be in the circuit.

As illustrated in FIG. 1, the support 16 is a mill and has a piston or sleeve 24 therein that is the trigger in this case. The piston 24 moves based upon fluid flow rate through the mill and closes the circuit as noted.

Figure 2:
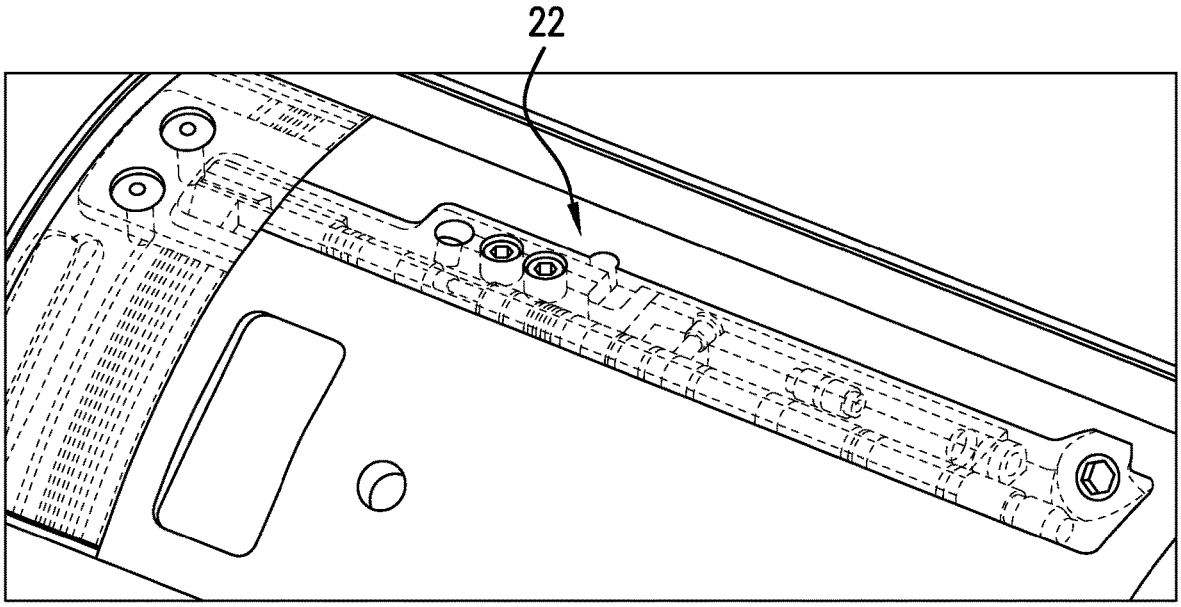
FIG. 2 is an enlarged view of one embodiment of an actuator usable in the system illustrated in FIG. 1.

The actuator 22 may be any type of actuator capable of releasing potential energy of a biaser 26, such as a coil spring, in order to move the anchor 14. In one embodiment, as illustrated in FIG. 2, the actuator is a commercially known actuator available under the trade name Sonos™ actuator from Baker Hughes. The energy from the biaser 26 causes the anchor 14 to set and secure the whipstock 12 in position.

Figure 3:
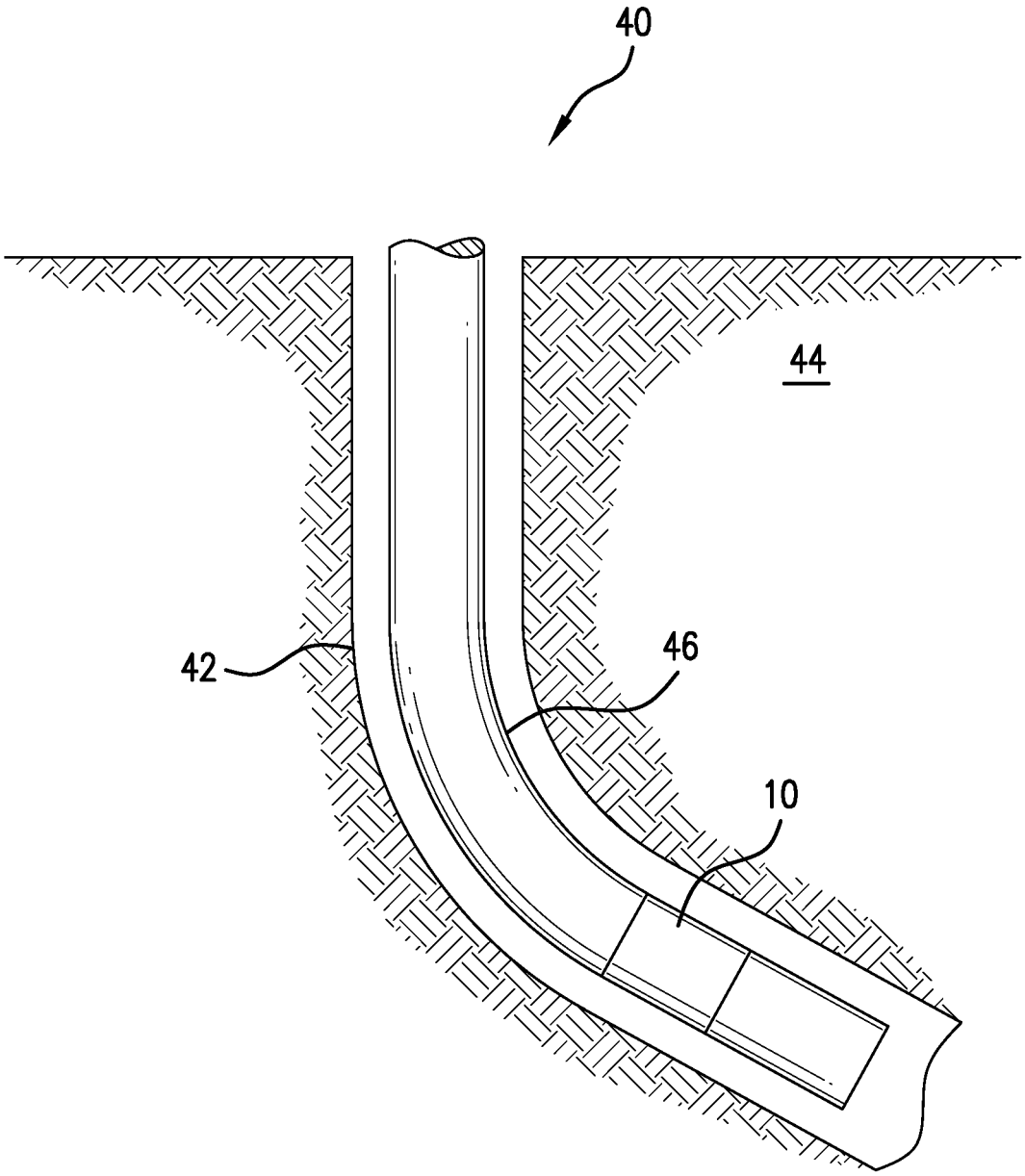
FIG. 3 is a view of a borehole system including the whipstock anchor system as disclosed herein.

Referring to FIGS. 1-3 simultaneously, a method for setting a whipstock anchor system 10 is disclosed. The method comprises running the whipstock anchor system 10 described above into a borehole 42 to a target depth. Flowing fluid through the borehole 42 at a rate at or greater than a preselected threshold rate and triggering the trigger 18, responsive to that flow. The flow may cause a mechanical motion of a component, such as a piston or sleeve, or may be simply measured by a sensor that triggers the closing of the circuit. Upon the closing of the circuit, the method includes sending a signal through the signal line 20 to the actuator 22. The method further comprises releasing stored potential energy in the form of the biaser 26 and setting the anchor 14.

Referring to FIG. 3, a borehole system 40 is illustrated. The system 40 comprises the borehole 42 in a subsurface formation 44. A string 46 is disposed within the borehole 42. A whipstock setting arrangement 10 as disclosed herein is disposed within or as a part of the string 46.

Set forth below are some embodiments of the foregoing disclosure:

Embodiment 1: A whipstock anchor system including a whipstock, an anchor attached to the whipstock, an actuator operably connected to the anchor, and a whipstock support connected by a signal capable line to the actuator, the support including a trigger responsive to a flow rate of fluid past the support.

Embodiment 2: The system as in any prior embodiment, wherein the support is in weight bearing connection to the whipstock before setting of the anchor.

Embodiment 3: The system as in any prior embodiment, wherein the signal capable line is an electric line.

Embodiment 4: The system as in any prior embodiment, wherein the trigger is a movable member disposed in the whipstock support.

Embodiment 5: The system as in any prior embodiment, wherein the support is a mill.

Embodiment 6: The system as in any prior embodiment, wherein the trigger is a piston.

Embodiment 7: The system as in any prior embodiment, wherein responsive to fluid flow rate, the trigger completes a circuit and thereby generates a signal to the actuator.

Embodiment 8: The system as in any prior embodiment, further including a power source on the support.

Embodiment 9: The system as in any prior embodiment, wherein the power source is a battery.

Embodiment 10: The system as in any prior embodiment, wherein the whipstock includes a setting biaser that stores potential energy and that is releasable by the actuator to set the anchor.

Embodiment 11: The system as in any prior embodiment, wherein the biaser is a spring.

Embodiment 12: A method for setting a whipstock anchor including running the system as in any prior embodiment to a target depth, flowing fluid to a threshold rate, closing the trigger to complete a circuit, sending a signal with the closed circuit to the actuator, and setting the anchor.

Embodiment 13: The method as in any prior embodiment, wherein the setting the anchor includes releasing stored potential energy with the actuator.

Embodiment 14: The method as in any prior embodiment, further including kinetically setting the anchor by driving a slip radially outwardly of the whipstock with the released potential energy of a biaser.

Embodiment 15: The method as in any prior embodiment, wherein the closing the trigger is by moving a member with fluid flowing at the threshold rate.

Embodiment 16: The method as in any prior embodiment, wherein the member is a piston.

Embodiment 17: The method as in any prior embodiment, wherein the signal is electric.

Embodiment 18: A borehole system including a borehole in a subsurface formation, a string in the borehole, a whipstock anchor system as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A whipstock anchor system comprising:
a whipstock;
an anchor attached to the whipstock;
an actuator operably connected to the anchor; and
a whipstock support connected by a signal capable line to the actuator, the support including a trigger comprising a sensor configured to measure a flow rate of fluid past the support, the trigger, when measuring a threshold flow rate, sending a signal to the actuator.

2. The system as claimed in claim 1, wherein the support is in weight bearing connection to the whipstock before setting of the anchor.

3. The system as claimed in claim 1, wherein the signal capable line is an electric line.

4. The system as claimed in claim 1, wherein the trigger is a movable member disposed in the whipstock support.

5. The system as claimed in claim 4, wherein the support is a mill.

6. The system as claimed in claim 1, wherein the trigger is a piston.

7. The system as claimed in claim 1, wherein responsive to fluid flow rate, the trigger completes a circuit and thereby generates a signal to the actuator.

8. The system as claimed in claim 1, further including a power source on the support.

9. The system as claimed in claim 8, wherein the power source is a battery.

10. The system as claimed in claim 1, wherein the whipstock includes a setting biaser that stores potential energy and that is releasable by the actuator to set the anchor.

11. The system as claimed in claim 10, wherein the biaser is a spring.

12. A method for setting a whipstock anchor comprising:
running the system as claimed in claim 1 to a target depth;
flowing fluid to a threshold rate;
closing the trigger to complete a circuit;
sending a signal with the closed circuit to the actuator; and
setting the anchor.

13. The method as claimed in claim 12, wherein the setting the anchor includes releasing stored potential energy with the actuator.

14. The method as claimed in claim 12, further including kinetically setting the anchor by driving a slip radially outwardly of the whipstock with the released potential energy of a biaser.

15. The method as claimed in claim 12, wherein the closing the trigger is by moving a member with fluid flowing at the threshold rate.

16. The method as claimed in claim 15, wherein the member is a piston.

17. The method as claimed in claim 12, wherein the signal is electric.

18. A borehole system comprising:
a borehole in a subsurface formation;
a string in the borehole;
a whipstock anchor system as claimed in claim 1 disposed within or as a part of the string.

19. A whipstock anchor system comprising:

a whipstock;

an anchor attached to the whipstock;

an actuator operably connected to the anchor; and a whipstock support connected by a signal capable line to the actuator, the support including a trigger responsive to a flow rate of fluid past the support, the trigger when experiencing a threshold flow rate sending a non-hydraulic signal to the actuator.

* * * * *